United States Patent [19]

Kobayashi

[11] 4,092,156

[45] May 30, 1978

[54] PROCESS FOR PREPARING TITANIUM CARBIDE BASE POWDER FOR CEMENTED CARBIDE ALLOYS

[76] Inventor: Yoshinobu Kobayashi, 3599-73, Honmachida, Machida-shi, Tokyo, Japan

[21] Appl. No.: 744,455

[22] Filed: Nov. 23, 1976

[51] Int. Cl.[2] ..... B22F 1/00

[52] U.S. Cl. ..... 75/203; 75/204; 75/213

[58] Field of Search ..... 75/203, 204, 213

[56] References Cited

U.S. PATENT DOCUMENTS

| | | | |
|---|---|---|---|
| 3,490,901 | 1/1970 | Hachisuka | 75/213 |
| 3,704,115 | 11/1972 | Wastenson et al. | 75/203 |
| 3,756,787 | 9/1973 | De Lange et al. | 75/204 |
| 3,762,919 | 10/1973 | Daniels | 75/213 |

*Primary Examiner*—Brooks H. Hunt

*Attorney, Agent, or Firm*—Larson, Taylor and Hinds

[57] ABSTRACT

A process comprises the steps of molding a mixture of usual TiC powder material having a combined carbon content lower than the theoretical value and a required amount of binder metal, sintering the molded mixture at a high temperature of about 1550° to 2500° C, and maintaining the sintered product at the high temperature, whereby the combined carbon content is increased to the highest possible value approximate to the theoretical value and the binder metal is fully effectively fused to the surface of the TiC particles. The resulting product is readily crushable to a powder having greatly improved amenability to sintering.

8 Claims, No Drawings

PROCESS FOR PREPARING TITANIUM CARBIDE BASE POWDER FOR CEMENTED CARBIDE ALLOYS

The present invention relates to a novel process for preparing titanium carbide base powders for the production of cemented carbide alloys.

Conventionally, cemented carbide alloy machines, tools and abrasion-resistant parts are produced by press-molding a powder composition such as WC-Co base, WC-TiC-TaC base or like composition and sintering the resulting molded mass by powder metallurgy techniques.

However, since tungsten is heavier than other metals, the product prepared therefrom is difficult to handle and install. Further because of the limited availability of the tungsten ore, cemented carbide alloys produced therefrom are very expensive.

Titanium appears to be free of these problems and serviceable as a substitute for tungsten used as a base metal of cemented carbide alloys. For use in place of tungsten as a material of cemented carbides, titanium must be converted to titanium carbide. For this purpose, three methods are known: a first method in which $TiO_2$ is reduced directly with carbon, a second method in which $TiH_2$ is carbonized with addition of carbon, and a third method which is the so called "menstruum process." With the first method, the higher the temperature at which $TiO_2$ is treated in a high degree of vacuum, the higher will be the content of combined carbon in the resulting TiC, but titanium oxide is produced during the reducing process in the form of a eutectic mixture, i.e. TiC-TiO, which is very difficult to reduce. Similarly, the second method involves the formation of a TiC-Ti eutectic mixture which is very difficult to carbonize. According to the third method, Ti is reduced in a bath of low-melting reducing metal such as aluminum. In the course of the reduction, Ti reacts with carbon mixed therewith or with the carbon contained in the reaction vessel itself, forming TiC crystals. The titanium carbide obtained by this method has a combined carbon content most approximate to the theoretical value. However, whichever of the foregoing methods is resorted to, the combined carbon content of TiC industrially available at present is limited to 19.2 to 19.6% which is lower than the theoretical value of 20.05%.

Thus it is very difficult to produce highly pure TiC having a combined carbon content approximately equal to the theoretical value. In other words, titanium carbide heretofore available contains a relatively large amount of free carbon. As a result, TiC-TiO, TiC-Ti or like eutectic mixture reacts with the nickel or cobalt binder used, forming a double carbide phase, seriously reducing the binding effect of the binder metal. Moreover, TiC particles having a highly reactive surface tend to undergo oxidation on the surface, failing to combine with the binder metal with high bond strength. Accordingly although sintered alloys prepared from TiC particles can be harder than WC base alloys, they have lower flexural strength and lower toughness than WC base alloys. The TiC particles produced by the foregoing methods fail to give alloys having the properties required of cemented carbide alloy machines, tools and abrasion-resistant parts.

Various other attempts have also been made for the development of TiC base cemented carbide alloys. The TiC-$Mo_2C$-Ni base alloy developed by Ford Company of U.S. in 1964 is known to have high hardness of 90.5 in terms of Rockwell A hardness as a TiC base cemented carbide alloy, but the flexural strength of the alloy is as low as 60 to 120 kg/mm$^2$, thus failing to fulfill the requirement for use as a cemented carbide alloy. Presumably, the inferior properties are attributable to the fact that the TiO and Ti contained in the TiC component impair the properties of Ni used as a binder and also to the presence of an oxide which is formed on the surface of TiC particles during sintering and handling and which prevents effective bonding between the TiC particles with the Ni binder. Because of these problems, hardly any progress has been made ever since in the development of and research on TiC-Ni base or TiC-Co base cemented carbide alloys.

The present invention provides a novel process for preparing titanium carbide base powders for the production of cemented carbide alloys which process has been accomplished based on extensive research I have carried out in order to overcome the drawbacks of the conventional processes described.

The main object of this invention is to provide titanium carbide base powders for the production of cemented carbide alloys which are lightweight, easy to handle and inexpensive to manufacture, without using tungsten which is heavy and expensive because of the limited resource.

Another object of this invention is to provide titanium carbide base powders for the production of cemented carbide alloys wherein the oxide covering the surface of TiC particles has been removed to the greatest possible extent and which contain TiC having a high content of combined carbon approximate to the theoretical value, the titanium carbide particles thus being rendered very compatible with a binder metal and bondable with greatly improved strength so as to give cemented carbide alloys fulfilling the desired requirements in respect of hardness, flexural strength and toughness.

Another object of this invention is to provide titanium carbide base powders which can be manufactured with ease because an intermediate product thereof obtained by sintering the starting material in the course of production is readily crushable.

The process of this invention for preparing a titanium carbide base powder for the production of cemented carbide alloys comprises the steps of molding a mixture of TiC powder starting material and an amount of binder metal powder required for sintering the TiC material, the TiC material having a combined carbon content lower than the theoretical value; sintering the molded mixture by heating the mixture at a high temperature under conditions inert to TiC; maintaining the sintered product at the high temperature to fully remove the resulting oxide from the surface of the TiC particles and to thereby render the TiC particles highly compatible with the binder metal, causing the binder metal to fuse onto the surface of the TiC particles while permitting the binder metal to form pores by its partial pressure within the resulting binder metal phase of the sintered product; and crushing the sintered product after cooling the product to thereby obtain a powder composed of TiC particles having the highest possible content of combined carbon approximate to the theoretical value, provided with binder metal fused to the surface of the particles with high strength and exhibiting high amenability to sintering.

The TiC powder used as the starting material is one commercially available and having a lower combined carbon content than the theoretical value. With this invention, the combined carbon content of the powder can be as low as about 18.00%. Useful TiC powders include a mixture of Ti powder and an amount of carbon required for preparing TiC.

Examples of useful binder metals are those generally used; e.g. Ni and Co which are used alone or admixture. The ratio in amount of the binder metal or metals to the TiC powder starting material is 50-10:50-90 by weight. Usually the binder metal is thoroughly mixed with the TiC powder in a ball mill for a prolonged period of time. $Mo_2C$, WC and TaC may further be added to the mixture as a sintering reaction accelerating agent. The resulting mixture is usually press-molded with use of a mold, but use of the mold is not critical; for example the mixture may be manually molded. The molded mixture is then sintered by being heated at a high temperature of 1550° to 2500° C under conditions inert to TiC, namely in a vacuum or in an argon gas, nitrogen gas or like inert gas atmosphere. Experiments have revealed that the most preferable sintering temperature is about 2200° C. With this invention, the heat treatment is not discontinued immediately after the molded mixture has been sintered, but the sintered product is continuously maintained at a temperature within the foregoing range for a period of time which is variable with the heating temperature. Generally the sintered product is maintained at the above-mentioned temperature for a period of time required to fully deoxidize the surface of the TiC particles, causing the binder metal to firmly fuse onto the surface, and to increase the combined carbon content of the TiC to the highest possible value close to the theoretical value, while permitting part of the binder metal phase precipitated out in the sintered product to vaporize and form pores in the metal phase due to the partial pressure of the metal.

According to the present invention the oxide on the surface of the TiC particles in removable to the greatest possible extent and the combined carbon content of the TiC is increasable nearly to the theoretical value by the high-temperature heat treatment, whereby the TiC particles are rendered highly compatible with the binder metal, enabling the binder metal to fuse to the surface of the TiC particles with high strength. Consequently the titanium carbide base powder obtained by the present process is much more amenable to sintering than the powders of the same type heretofore available, with the resulting advantage that the cemented carbide alloys prepared from the powder by re-sintering have the hardness required of cemented carbide alloys as well as satisfactory flexural strength and toughness and are therefore well-suited for the manufacture of cemented carbide alloy machines, tools and various wear-resistant parts. The titanium carbide base powder of this invention has another advantage that because expensive and heavy tungsten is not used as a material, the cemented carbide alloy products and parts prepared therefrom are lightweight, easy to handle and inexpensive. Furthermore according to this invention, the sintered product obtained is readily crushable to the desired powder due to the presence of the pores which are formed by vaporizing part of the binder metal phase of the sintered body through the high-temperature treatment.

Examples of this invention are given below.

EXAMPLE 1

To 75% by weight of TiC powder starting material comprising commercial TiC powder (containing 19.7% by weight of combined carbon and 0.1% by weight of free carbon) and 0.55% by weight of carbon added to the TiC powder was added 25% by weight of carbonyl nickel as Ni, the ingredients were mixed together in a ball mill for 48 hours, and the mixture was pressed in a mold. The molded mixture was then heated for sintering at 1500° C in a vacuum furnace to obtain a test piece, which was found to have the following properties.

| | |
|---|---|
| Flexural strength: | 90 kg/mm$^2$. |
| Hardness, Rockwell A: | 90.2. |
| Free carbon in the sintered product: | Corresponding to ASTM C4. |
| Pores in the sintered product: | Corresponding to ASTM B4. |

Thus the test piece had poor flexural strength. The test piece was then heated at about 2400° C for 1 to 1.5 hours in an argon gas atmosphere which is inert to TiC, causing part of the nickel phase between the TiC particles to vaporize and produce pores. The resulting product was readily crushable due to the presence of the pores. The TiC base powder obtained had a combined carbon content approximate to the theoretical value and was composed of TiC particles substantially free of oxide on their surface and having Ni fused to the surface with high bond strength.

To 93.7% by weight of the TiC-Ni powder (24% by weight of Ni and 1.6 $\mu$ in particle size) were added 6.0% by weight of Ni and 0.3% by weight of C, the ingredients were mixed together in a ball mill for 24 hours, and the mixture was pressed in a mold with use of paraffin wax as a binder-lubricant. The molded product was then dewaxed by being heated to 1200° C and thereafter heated at 1400° C in a vacuum furnace for sintering. The sintered product was found to have the following properties.

| | |
|---|---|
| Flexural strength: | 161 kg/mm$^2$. |
| Hardness, Rockwell A: | 88.80. |
| Free carbon in the sintered product: | Corresponding to ASTM C2. |
| Pores in the sintered product: | Corresponding to ASTM A1. |

Thus the test piece had greatly improved flexural strength.

When the above procedures were repeated in the same manner as above except that 25% by weight of Ni was replaced by 25% by weight of Co, or by equal amounts of Ni and Co, substantially the same results as above were obtained.

EXAMPLE 2

To 71% by weight of TiC powder starting material comprising commercial TiC powder (containing 19.6% by weight of combined carbon and 0.3% by weight of free carbon) and 0.45% by weight of carbon added to the TiC powder were added 25% by weight of carbonyl nickel as Ni and 4.0% by weight (theoretical amount) of $Mo_2C$ as a sintering reaction accelerating agent, and the ingredients were mixed together and molded in the same manner as in Example 1. The molded mixture was then heated for sintering at 1520° C in a vacuum furnace to obtain a test piece, which was found to have the following properties.

| | |
|---|---|
| Flexural strength: | 112 kg/mm². |
| Hardness, Rockwell A: | 89.6. |

Thus the test piece had poor flexural strength. The test piece was then heated at a progressively increasing temperature of from about 1500° to 1700° C and finally heated to about 2200° C. The heating was continued for 1 to 1.5 hours in a hydrogen gas atmosphere which is inert to TiC, causing part of the nickel phase between the TiC particles to vaporize and produce pores, whereby a skeletal product was obtained. The product was readily crushable due to the presence of the pores. The Tic base powder obtained had a combined carbon content approximate to the theoretical value and was composed of TiC particles substantially free of oxide on their surface and having Ni completely fused to the surface.

To 94.75% by weight of the TiC-$Mo_2C$-Ni powder were added 5% by weight of Ni and 0.25% by weight of C, the ingredients were mixed together in a ball mill for 24 hours, and the mixture was pressed in a mold with use of paraffin wax as a binder-lubricant. The colded product was then dewaxed by being heated to 1150° C and thereafter heated at 1470° C in a vacuum furnace for sintering. The sintered product was found to have the following properties.

| | |
|---|---|
| Flexural strength: | 180 kg/mm². |
| Hardness, Rockwell A: | 88.20. |
| Free carbon in the sintered product: | Corresponding to ASTM C2. |
| Pores in the sintered product: | Corresponding to ASTM A1. |

Thus the test piece had outstanding flexural strength.

What is claimed is:

1. A process for preparing a titanium carbide base powder for cemented carbide alloys comprising the steps of molding a mixture of TiC powder starting material and an amount of binder metal powder required for sintering the TiC material, the TiC material having a combined carbon content lower than the theoretical value and containing free carbon; sintering the molded mixture by heating the mixture at a temperature of about 1550° to 2500° C under conditions inert to TiC; maintaining the sintered product at said high temperature for a time sufficient to fully deoxidize from the surface of the TiC particles thereby rendering the TiC particles highly compatible with the binder metal, causing the binder metal to fuse onto the surface of the TiC particles while permitting the binder metal to vaporize and form pores by its partial pressure within the resulting binder metal phase of the sintered product and increasing the combined carbon content of the TiC to the highest possible value approximate to the theoretical value; and crushing the sintered product after cooling the product to thereby obtain a powder composed of TiC particles having the highest possible content of combined carbon approximate to the theoretical value, provided with binder metal fused to the surface of the particles with high strength and exhibiting high amenability of sintering.

2. A process as defined in claim 1 wherein the binder metal is nickel.

3. A process as defined in claim 1 wherein the binder metal is cobalt.

4. A process as defined in claim 1 wherein the binder metal is a mixture of nickel and cobalt.

5. A process as defined in claim 1 wherein the molded misture is heated at 1550° to 2500° C in a vacuum furnace and is thereby sintered.

6. A process as defined in claim 1 wherein the molded misture is heated at 1500° to 2500 ° C in an inert gas atmosphere and is thereby sintered.

7. A process for preparing a titanium carbide base powder for cemented carbide alloys comprising the steps of molding a mixture of TiC powder starting material, an amount of binder metal powder required for sintering the TiC material and a sintering reaction accelerating agent, the TiC material having a combined carbon content lower than the theoretical value; sintering the molded mixture by heating the mixture at a high temperature of 1500° to 2500° C under conditions inert to TiC; maintaining the sintered product at the high temperature to fully deoxidize the surface of the TiC particles and to thereby render the TiC particles highly compatible with the binder metal, causing the binder metal to fuse onto the surface of the TiC particles while permitting the binder metal to form pores by its partial pressure within the resulting binder metal phase of the sintered product; and crushing the sintered product after cooling the product to thereby obtain a powder composed of TiC particles having the highest possible content of combined carbon approximate to the theoretical value, provided with binder metal fused to the surface of the particles with high strength and exhibiting high amenability to sintering.

8. A process as defined in claim 7 wherein the sintering reaction accelerating agent is $Mo_2C$, WC or TaC.

* * * * *